US006889621B2

(12) United States Patent
Kawaguchi et al.

(10) Patent No.: US 6,889,621 B2
(45) Date of Patent: May 10, 2005

(54) ARTICLE SUPPORTING DEVICE FOR SEWING MACHINE AND SEWING MACHINE

(75) Inventors: Yasuhiko Kawaguchi, Nagoya (JP); Yasukazu Noguchi, Nagoya (JP); Masato Kato, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/771,350

(22) Filed: Feb. 5, 2004

(65) Prior Publication Data

US 2004/0173130 A1 Sep. 9, 2004

(30) Foreign Application Priority Data

Feb. 10, 2003 (JP) ..... 2003-031956

(51) Int. Cl.[7] ..... D05C 9/04
(52) U.S. Cl. ..... 112/103
(58) Field of Search ..... 38/102.2; 70/192, 70/DIG. 73; 112/103, 470.06, 470.14, 475.11, 475.18; 24/455

(56) References Cited

U.S. PATENT DOCUMENTS 4,628,843 A * 12/1986 Tajima ..... 112/103
5,167,194 A * 12/1992 Nakagaki ..... 112/103
5,832,853 A * 11/1998 Pokrishevsky et al. . 112/475.11
6,065,413 A * 5/2000 Kawaguchi ..... 112/470.14
6,189,468 B1 * 2/2001 French ..... 112/103
6,279,498 B1 * 8/2001 Hattori et al. ..... 112/103
6,463,867 B2 * 10/2002 Kato ..... 112/103
6,782,836 B1 * 8/2004 Hales ..... 112/103

FOREIGN PATENT DOCUMENTS

| | | |
|---|---|---|
| JP | A 11-21757 | 1/1999 |
| JP | B2 2958947 | 7/1999 |
| JP | B2 3178022 | 4/2001 |

* cited by examiner

*Primary Examiner*—Ismael Izaguirre
(74) *Attorney, Agent, or Firm*—Oliff & Berridge, PLC

(57) ABSTRACT

An article supporting device is detachably mounted on a sewing machine including a sewing machine body with a moving mechanism for moving an article to be sewn, thereby holding the article. The article supporting device includes a support body mounted on the sewing machine body, a support frame detachably attached to the support body while the article is held on support frame, and a pressed portion mounted on the support body to be pressed so that the support body is pressed in a direction opposed to a direction in which the support frame is detached from the support body.

12 Claims, 10 Drawing Sheets

ARTICLE SUPPORTING DEVICE FOR SEWING MACHINE AND SEWING MACHINE

BACKGROUND OF THE INVENTION

1. Field of the Invention

This invention relates to an article supporting device to which a support frame for supporting an article on which embroidery patterns or stitches are to be formed or a cap frame for supporting a cap is detachably attached and a sewing machine provided with the article supporting device.

2. Description of the Related Art

There have conventionally been provided various types of sewing machines in which a cap is rotated with a cap frame so that an embroidery pattern can be sewn on a front, or right or left side of the cap. For example, Japanese Patent No. 2958947 discloses a sewing machine comprising a moving frame moved independently in the X direction (right-and-left) perpendicular to a cylinder bed and in the Y direction (back-and-forth) and a cap frame supporting device detachably mounted on the moving frame. The cap frame supporting device of the sewing machine comprises a body and a cap frame detachably attached to the body for holding a cap. The body of the cap frame supporting device and the cap frame are moved in the Y direction when the cloth feed frame is moved in the Y direction. Drive of the cloth feed frame in the X direction is converted by a rotating mechanism of the body to rotational movement, whereby only a rotating frame of the body is rotated together with the cap frame so that an embroidery pattern can be sewn on a front, or right or left side of the cap.

When the cap frame is attached to the body in the above-noted sewing machine, an operator fits the cap frame with the rotating frame and presses the cap frame forward while sliding the cap frame on an outer periphery of the rotating frame, so that four engagement members provided on the outer periphery of the rotating frame are engaged with engagement holes of the cap frame respectively. Thus, the cap frame is attached to the rotating frame. On the other hand, when the cap frame is detached from the rotating frame, only the cap frame is pulled forward so that the cap frame is disengaged from the engagement members, whereby the cap frame is detached from the rotating frame.

In the above-described cap frame supporting device, however, an embroidery pattern cannot be sewn when the cap frame has been detached from the rotating frame or displaced from a proper position due to oscillation caused by the sewing machine. In view of this problem, the cap frame is firmly mounted to the body by the engagement member. Accordingly, when only the cap frame is to be detached from the rotating frame, the operator needs to exert a strong force to the cap frame to manually pull it forward. This is not an easy work for some operators or users. In this case, there is a possibility that the sewing machine body may also be dragged with the cap frame when the cap frame is pulled forward. Additionally, there is also a possibility that the operator may fall heavily on his or her backside when having forcibly pulled the cap frame off.

SUMMARY OF THE INVENTION

Therefore, an object of the present invention is to provide an article supporting device in which the support frame holding the article to be sewn or the cap frame holding the cap can easily be detached and a sewing machine provided with such article supporting device.

The present invention provides an article supporting device detachably mounted on a sewing machine including a sewing machine body provided with a moving mechanism for moving an article to be sewn, thereby holding the article. The article supporting device comprises a support body mounted on the sewing machine body, an engaging member mounted on the support body, a support frame detachably attached to the support body by the engaging member while the article is held thereon, and a pressed portion provided on the engaging member to be pressed to disengage the engaging member from the support frame and so that the support body is pressed in a direction opposed to a direction in which the support frame is detached from the support body.

When detaching the support frame from the support body, the operator pulls the support frame in the detaching direction while pressing the pressed portion in the opposite direction to the detaching direction. In this case, the operator receives a reaction force of the pressing force applied to the support frame. The reaction force acts in the detaching force from the pressed portion. Since the reaction force is utilized for detachment of the support frame, the detaching work can be simplified as compared with a case where the support frame is detached only by pulling it. Furthermore, the sewing machine body can be prevented from being dragged with the support frame. Additionally, the article supporting device has a simple construction in which the pressed portion is merely provided on the support body.

In a preferred form, the support body includes a moving portion moved by the moving mechanism, and the support frame is coupled to the moving portion while attached to the support body so as to be moved with the moving portion. Consequently, the article held on the support frame can be moved by the moving mechanism of the sewing machine body.

In another preferred form, the support frame is a cap frame holding a cap serving as the article. Caps can be held on the cap frame and sewn.

In further another preferred form, the two pressed portions are provided so as to be spaced away from a center of the support body in opposite directions so that the pressed portions are substantially equidistant from the center of the support body. Consequently, the operator can press the pressed portions with both of his or her hands in balance.

When the pressed portion comprises a protrusion protruding approximately perpendicularly to a direction in which the cap frame is detached, the pressed portion can be achieved by a simple construction and can be operated easily.

In further another preferred form, the cap frame includes a grip grasped when the cap frame is to be attached to and detached from the support body, and the pressed portion is located near the grip when the cap frame is attached to the support body. The operator can attach and detach the cap frame to and from the support body while grasping the grip of the cap frame. Since the pressed portion is located near the grip, the operator can easily operate the pressed portion even while grasping the grip in the detachment of the cap frame.

In further another preferred form, a plurality of the grips are provided and a plurality of the pressed portions are provided so as to correspond to the grips respectively. Consequently, the operator can easily operate the pressed portion when using any one or more of the grips.

In further another preferred form, the cap frame includes a visor support holding a visor of the cap, and the pressed portion is positioned outside the visor of the cap held by the visor support. Consequently, the operator can operate the pressed portion without being blocked by the visor of the cap.

In further another preferred form, the support body includes an engaging member capable of moving between an engagement position where the engaging member engages the cap frame thereby to hold the cap frame and a retreat position where the engaging member disengages the cap frame. In this case, the pressed portion is provided on the engaging member, and the pressed portion is pressed such that the engaging member is moved from the engagement position to the retreat position. In this construction, pressing the pressed portion serves as disengaging the engaging member from the cap frame. Accordingly, when the operator operates the pressed portion, disengagement of the engaging member and detachment of the cap frame are carried out serially. Consequently, the cap frame detaching work can be simplified.

In further another preferred form, the cap frame includes an engaged portion, the engaging member includes a rolling member engaging the engaged portion of the cap frame when the engaging member is located at the engagement position, and the pressed portion is located nearer to the cap frame than a central axis of the rolling member. As a result, the pressed portion can be operated easily.

In further another preferred form, the rolling member is rotatable in the directions in which the cap frame is attached to and detached from the support body. As a result, the frictional resistance caused by the rolling member upon detachment of the cap frame can be rendered small, whereupon the cap frame can be attached to and detached from the support body by application of a relatively smaller force.

The invention also provides a sewing machine which includes a sewing machine body further including a moving mechanism for moving an article to be sewn. The sewing machine comprises an article supporting device holding a cap serving as the article to be sewn and including a support body mounted on the sewing machine body, an engaging member mounted on the support body, a cap frame detachably attached to the support body by the engaging member while the cap is held on the cap frame, and a pressed portion provided on the engaging member, to disengage the engaging member from the support body, to be pressed so that the support body is pressed in a direction opposed to a direction in which the cap frame is detached from the support body. In the above-described sewing machine, the cap frame holding the cap can easily be detached from the support body.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

One embodiment of the present invention will be described with reference to the drawings. In the embodiment, the invention is applied to a cap frame supporting device including a cap frame holding a cap as an article to be sewn. The invention is also applied to a multi-head sewing machine for industrial use. The multi-head sewing machine carries out an embroidery sewing operation concurrently for a plurality of articles to be sewn or caps. In the following description, the location of the operator in front of the sewing machine will be referred to as "the front." The back-and-forth direction will be referred to as "the Y direction," whereas the right-and-left direction as viewed from the operator will be referred to as "the X direction."

Figure 1:
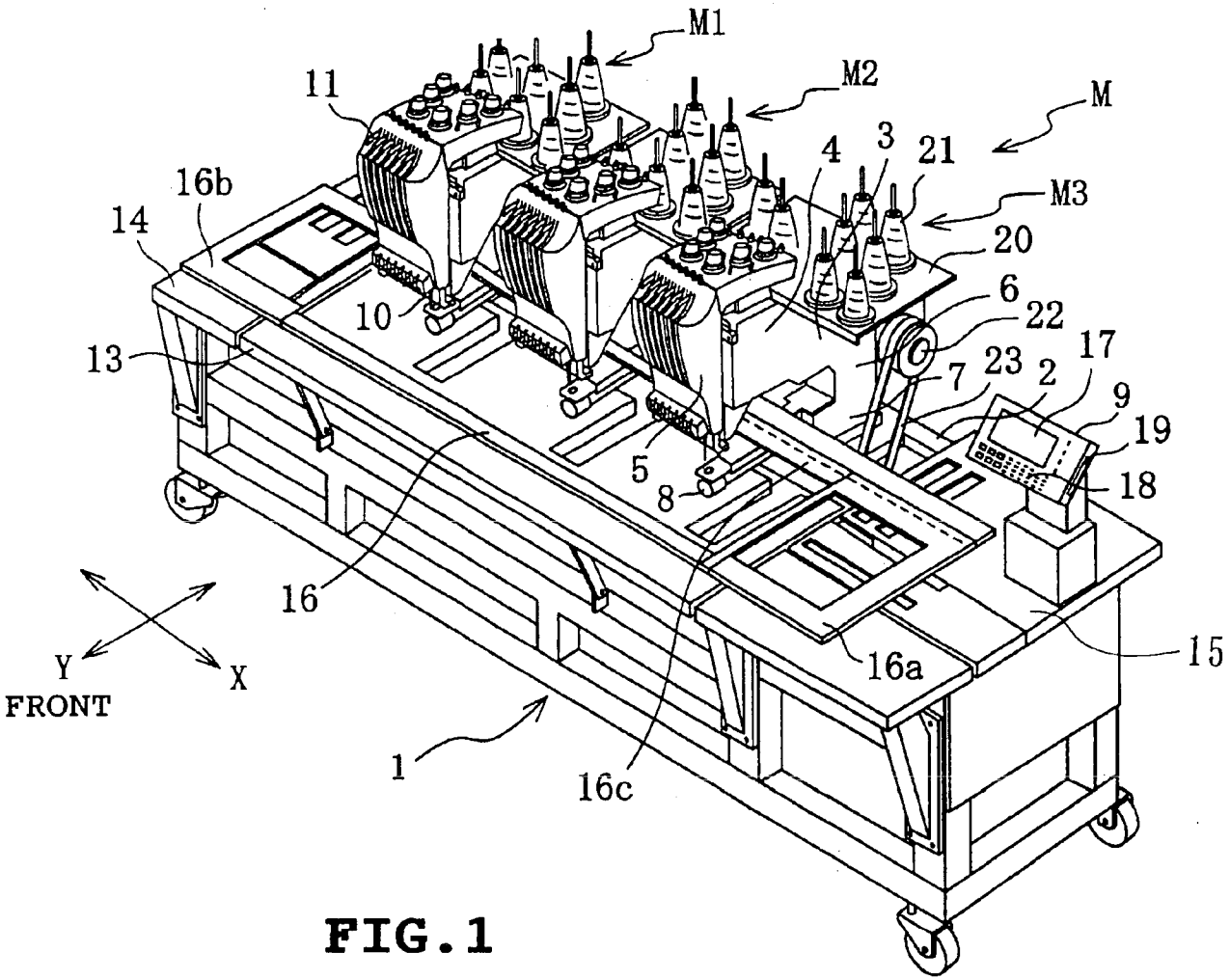
FIG. 1 is a perspective view of an overall multi-head sewing machine in accordance with one embodiment of the present invention.

Referring to FIG. 1, the construction of the body of the multi-head sewing machine M of the embodiment will first be described. The body of the multi-head sewing machine M comprises an embroidery machine base frame 1 extending in the X direction and a generally rectangular sewing machine support plate 2 provided on the rear top of the embroidery machine base frame 1. On the sewing machine support plate 2 are mounted three multi-needle embroidery sewing machines M1 to M3 having the same structure. The embroidery sewing machines M1 to M3 are juxtaposed in the X direction.

Each of the embroidery sewing machines M1 to M3 is constructed as follows. A sewing bed body 7 is mounted on the sewing machine support plate 2. A pillar 6 extends upward from a rear end side of the bed body 7. A sewing arm 3 extends frontward from an upper end of the pillar 6. A sewing head 4 is provided on a front end of the arm 3. A needle bar case 5 is mounted on a front end of the head 4 so as to be moved in the X direction. A cylinder bed 8 is mounted on a front end of the bed body 7 and extends frontward. The cylinder bed 8 has a needle hole 8*a* (see FIG. 2) formed in an upper face of a front end thereof. The needle hole 8*a* encloses a thread loop taker (not shown) and the like.

The needle bar case 5 includes, for example, six vertically movable needle bars (not shown) and six vertically movable thread take-up levers 11. A sewing needle 10 is mounted on a lower end of each needle bar. A spool holder base 20 having a plurality of spool holder pins 21 is mounted on the top of the arm 3. Six color-different threads are supplied from the spool holder pins 21 to the sewing needles 10 respectively.

The needle bar case 5 is moved by a needle bar selecting mechanism (not shown) so as to be moved in the X direction, whereby one of the needle bars to be driven is selected. Only the selected needle bar (the needle 10) and the thread take-up lever 11 corresponding to the selected needle bar are vertically moved by a driving force transmitted from a sewing machine motor (not shown) via a V-belt 23 and a spindle 22, whereby embroidery stitches are formed with a selected color of thread by cooperation of the selected needle bar and the thread loop taker also driven by the sewing machine motor.

A working table 13 movable upward and downward is provided in front of the sewing machine support plate 2. The working table 13 is moved up to a position level with the upper surface of the cylinder bed 8. A pair of auxiliary side tables 14 and 15 are provided at right and left sides of the working table 13. A rectangular moving frame extends over the side tables 14 and 15 in the X direction. The moving frame 16 includes two drive frames 16*a* and 16*b* and a pair of front and rear X-direction frames 16*c* extending over the drive frames 16*a* and 16*b* which are disposed on the side tables 14 and 15 respectively.

A moving mechanism including X-direction and Y-direction drive mechanisms is provided on the sewing machine support plate 2 although none of the mechanisms are shown. The right-hand drive frame 16*a* of the moving frame 16 is coupled with the X-direction drive mechanism of the moving mechanism, so that the moving frame 16 is moved in the X direction. The X direction frames 16*a* of the moving frame 16 are coupled with the Y-direction drive mechanism of the moving mechanism, so that the moving frame 16 is moved in the Y direction. An operation panel 9 is provided on a right end of the side table 15. The operation panel 9 is operated so that the operator enters various data etc. The operation panel 9 includes a display 17 for displaying various data such as embroidery data, operation switches 18 operated by the operator so that various data are entered, a flexible disc drive 19 and the like.

The multi-head sewing machine M is provided with a control device (not shown) including a microcomputer. The control device controls the sewing machine motor, the needle bar selecting mechanism and the X- and Y-direction drive mechanisms based on embroidery data, so that an article (a cap 95) supported on the moving frame 16 is automatically embroidered.

The cap frame support 30 (corresponding to an article frame support) mounted on each of the embroidery sewing machines M1 to M3 will now be described with reference to FIGS. 2 to 10. Referring to FIGS. 2 to 6 and 10, the cap frame support 30 includes a support body 31 moved in the back-and-forth direction (Y direction) with respect to the cylinder bed 8 and a cap frame 32 (corresponding to a support frame) detachably attached to the support body 31. The cap 95 serving as the article to be sewn is detachably attached to the cap frame 32.

The support body 31 includes a guide shaft 33 (see FIG. 3) extending in the Y direction below the moving frame 16, a base frame 34 supported on the guide shaft 33 so as to be moved in the Y direction along the guide shaft 33, and a rotation limiting mechanism 35 (see FIG. 4) limiting rotation of the base frame 34. The support body 31 further includes a rotating frame 36 serving as a moving portion supported on a shaft parallel to the base frame 34 extending in the Y direction so as to be rotated (coaxial rotation) about the shaft, a rotating mechanism 37 for rotating the rotating frame 36, and a connecting mechanism 38 (see FIG. 3) connecting the base frame 34 to the moving frame 16. The support body 31 still further includes a connecting plate 39 (see FIGS. 3 and 4) mounted on the base frame 34 so as to be directed vertically, a cap support plate 40 mounted on the front side of the connecting plate 39 to support an inner circumferential face of the cap 95, and a pair of guide rollers 41 guiding the rotating frame 36 at the inside.

Figure 3:
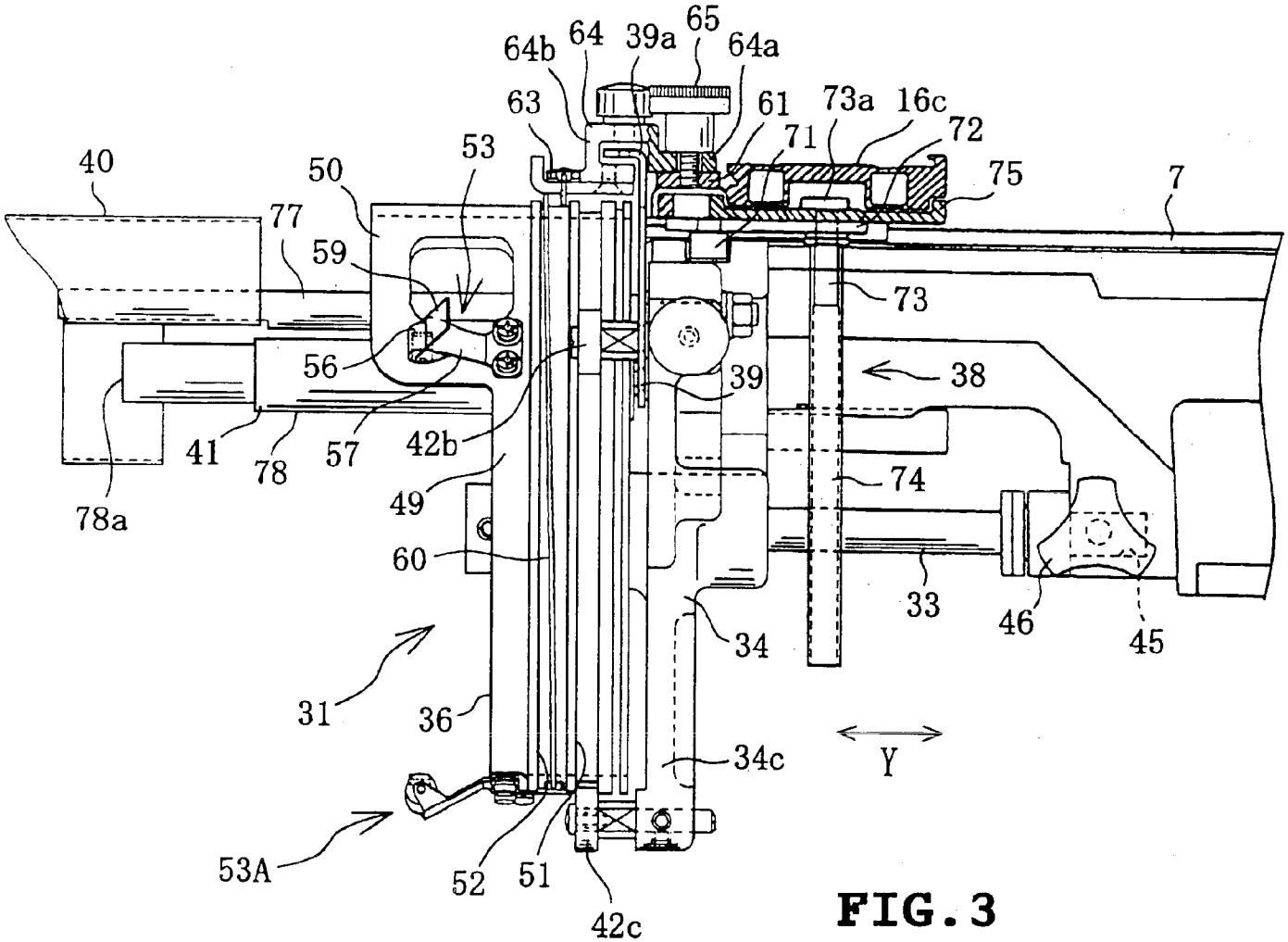
FIG. 3 is a side view of the support body of the cap frame support.
Figure 4:
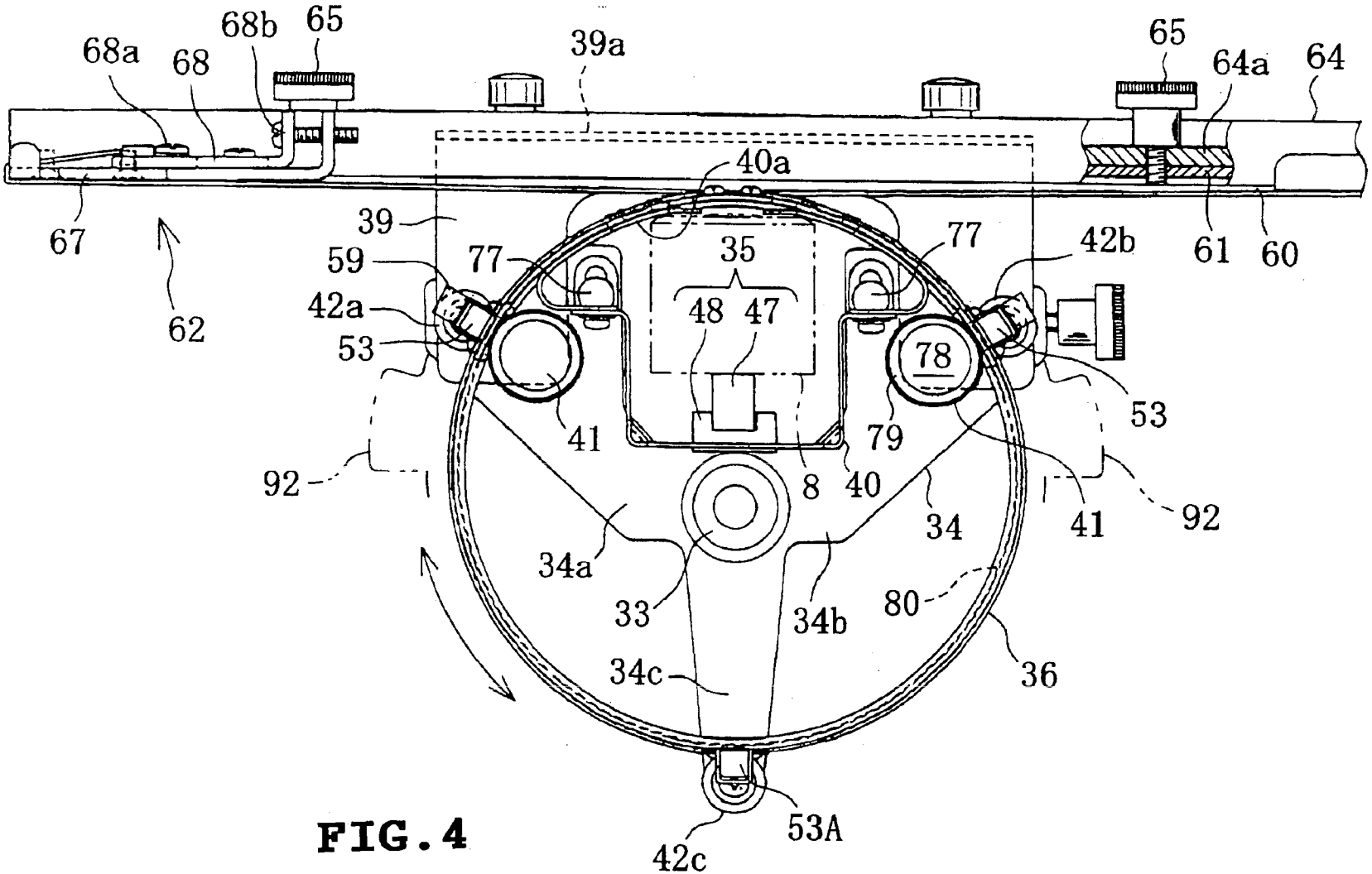
FIG. 4 is a front view of the support body.

The bed body 7 has an attachment hole 45 formed therein so as to extend horizontally in the Y direction as shown in FIG. 3. The guide shaft 33 is inserted from the front end into the attachment hole 45 and fixed to the bed body 7 by a screw fixture with a knob 46. The base frame 34 includes a centrally located boss and three generally Y-shaped arms 34*a*, 34*b* and 34*c* extending in the direction of outer circumference as shown in FIGS. 3 and 4. The boss of the base frame 34 is fitted with the guide shaft 33 so as to be slid in the Y direction along the guide shaft 33.

The connecting plate 39 is fixed to the upper arms 34*a* and 34*b* of the base frame 34. Rotating rollers 42*a*, 42*b* and 42*c* are mounted on left and right ends of the connecting plate 39 and the lower arm 34*c* respectively, thereby supporting the rotating frame 36 so that the rotating frame 36 is rotated, as shown in FIG. 4. An upper end of the connecting plate 39 has an upper end bent portion 39*a* formed into a generally C-shape integrally with the connecting plate 39 as shown in FIGS. 3 and 4.

The rotation limiting mechanism 35 includes a keying member 47 fixed to the backside of the cylinder bed 8 and a grooved piece 48 fixed to the base frame 34 as shown in FIG. 4. The grooved piece 48 has a groove extending in the Y direction. The keying member 47 engages the groove of the grooved piece 48. As the result of the above-described construction, the keying member 47 is slid in the groove of the grooved piece 48, whereby the rotation of the guide shaft 33 is limited while the base frame 34 is allowed to be moved in the Y direction.

Figure 2:
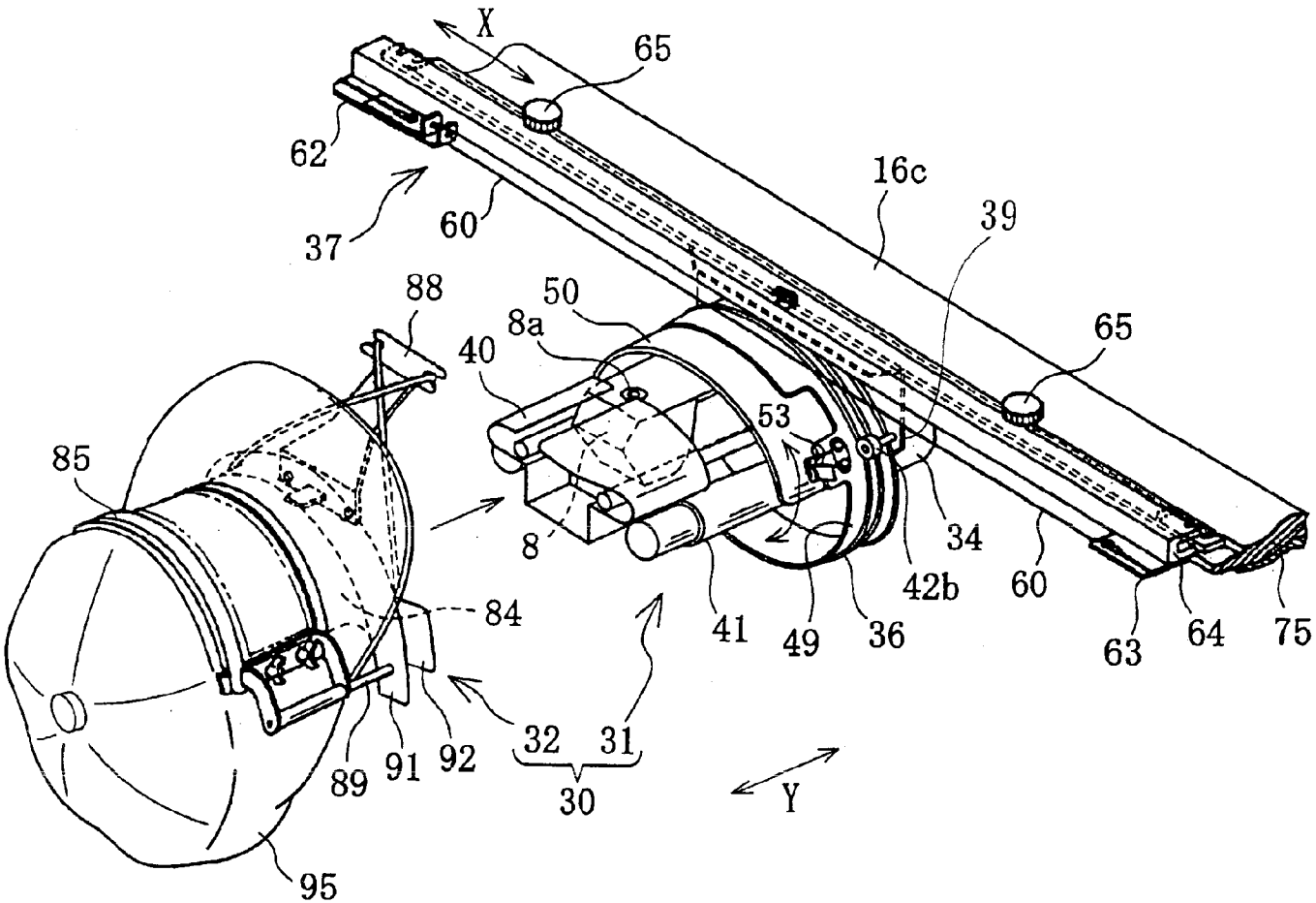
FIG. 2 is a perspective view of an overall cap frame support used in the multi-head sewing machine.

Referring to FIGS. 2 and 3, the rotating frame 36 includes a cylindrically annular portion 49 and a generally semicircular cap frame support 50 both of which are formed integrally with the rotating frame 36. The cap frame support 50 extends frontward a predetermined length from an upper half of the annular portion 49. The annular portion 49 has a roller groove 51 into which the rotating rollers 42*a*, 42*b* and 42*c* are fitted so as to be relatively slid along the roller groove 51. The annular portion 49 further has a wire guide groove 52 introducing a wire 60 of the rotating mechanism 37. The cap frame 32 which will be described in detail later is detachably attached to the cap frame support 50. In this case, an inner circumferential face of the cap frame 32 is closely fitted with an outer circumferential face of the cap frame support 50.

A pair of left and right engaging members 53 mounted on the left and right upper portions of the outer circumference of the annular portion 49. The engaging members 53 engage the cap frame 32 attached to the cap frame support 50 with the rotating frame 36, thereby fixing the cap frame 32 to the rotating frame 36. Further, an engaging member 53A having substantially the same construction as the engaging member 53 is provided on the outer circumferential lower end of the annular portion 49. The engaging member 53A engages a wider cap frame (not shown). The engaging member 53 will be described in detail later.

Figure 5:
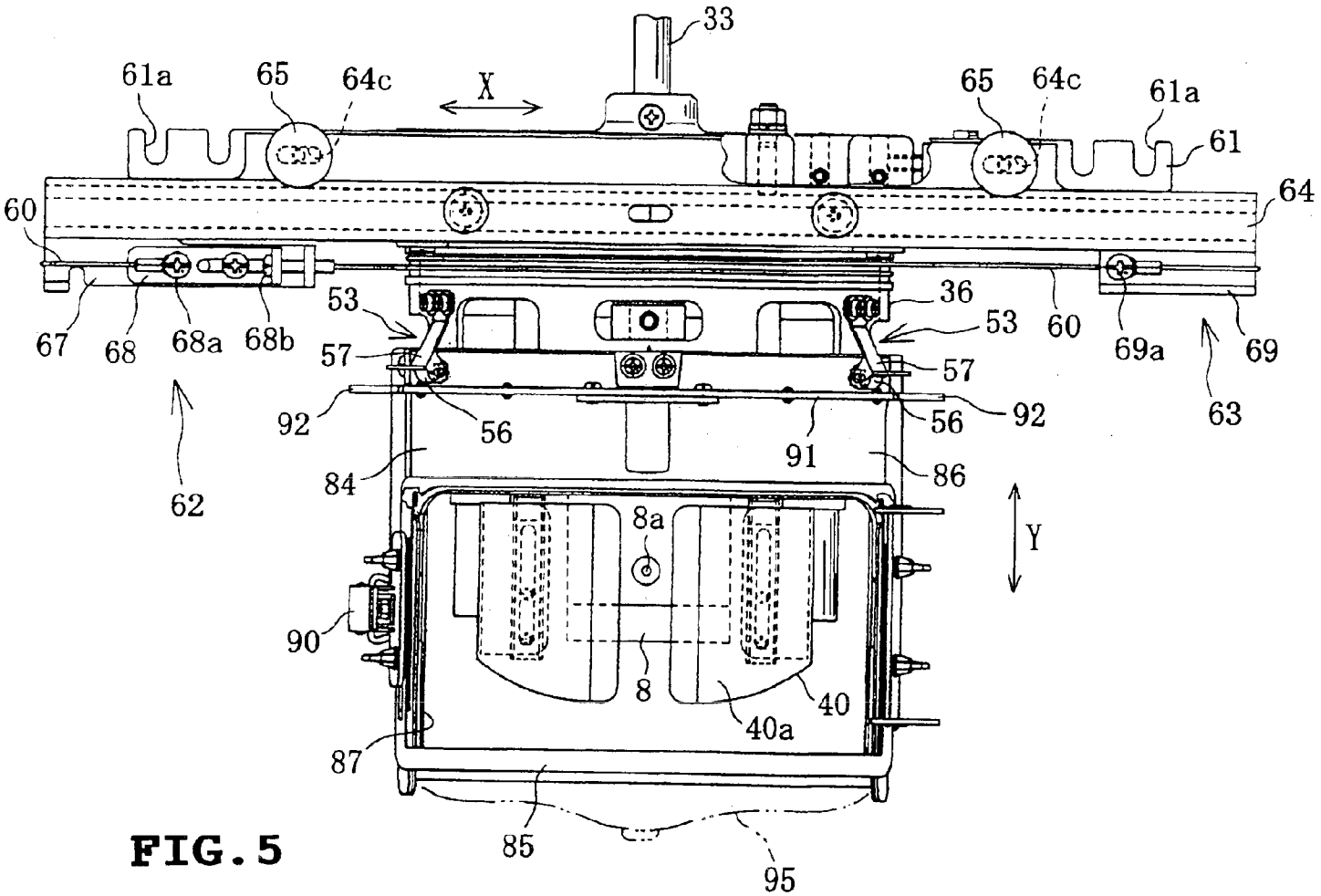
FIG. 5 is a plan view of the cap frame support.

Referring to FIGS. 3 to 5, the rotating mechanism 37 converts the movement of the moving frame 16 in the X direction to rotation of the rotating frame 36. The rotating mechanism 37 includes a wire 60 wound on a wire guide groove 52 of the rotating frame 36, a fixing member 61 which is elongated in the X direction and mounted on the moving frame 16, and a moving member 64 movable in the X direction relative to the base frame 34. The moving member 64 has wire connecting portions 62 and 63 which are formed on both ends of the moving member 64 and to which both ends of the wire 60 are connected respectively.

A pair of connecting grooves 61*a* are formed in both ends of the fixing member 61 located in the X direction respectively as shown in FIG. 5. Knobbed threaded pieces (not shown) having been inserted through the connecting grooves 61 respectively are threadedly engaged with the X-direction frame 16*c* while the underside of the fixing member 61 is in abutment with the X-direction frame 16*c*, whereby the fixing member 61 is fastened to the X-direction frame 16*c*.

The moving member 64 includes a horizontal plate portion 64*a* placed on and fixed to the fixing member 61 and an engaged portion 64*b* located in front of the horizontal plate portion 64*a* and engaged by the upper end bent portion 39*a* of the connecting plate 39, as shown in FIGS. 3 to 5. The horizontal plate portion 64*a* and the engaged portion 64*b* are formed integrally with the moving member 64. The moving member 64 is fixed to the fixing member 61 by inserting knobbed threaded members 65 threadedly engaged with the fixing member 61 into a pair of elongated holes 64*c* formed in the horizontal plate portion 64*a*, whereupon the moving member 64 is moved in the X direction together with the fixing member 61.

The wire connecting portion 62 provided on the left of the moving member 64 includes a connecting plate 67 secured to the underside of the moving member 64 so as to protrude frontward and having a standing right end, and a movable connecting piece 68 connected to the upper side of the connecting plate so as to be moved in the X direction, as shown in FIGS. 4 and 5. The wire 60 extending toward the left from the rotating frame 36 is bent upward at the left end of the connecting plate 67 so as to be returned. The end of the wire 60 is fixed to a pin 68*a* threadedly engaged with the movable connecting piece 68. A pin 68*b* is adjusted so that the movable connecting piece 68 can be moved in the right-and left direction.

On the other hand, aright wire connecting portion 63 includes a horizontal connecting plate 69 secured to the underside of the moving member 64 and protruding frontward, as shown in FIGS. 2, 3 and so on. The wire 60 extending rightward from the rotating frame 36 is bent at the end of the connecting plate 69 upward to be returned. The end of the wire 60 is fixed to the connecting plate 69 by a pin 69*a*. As the result of the above-noted construction, when the moving frame 16 is driven so as to be moved in the X direction, the fixing member 61 and the moving member 64 are moved together with the moving frame 16. With this movement, the rotating frame 36 on which the wire 60 with both ends fixed to the moving member 64 is wound is rotated by the rotating mechanism 37.

Figure 8:
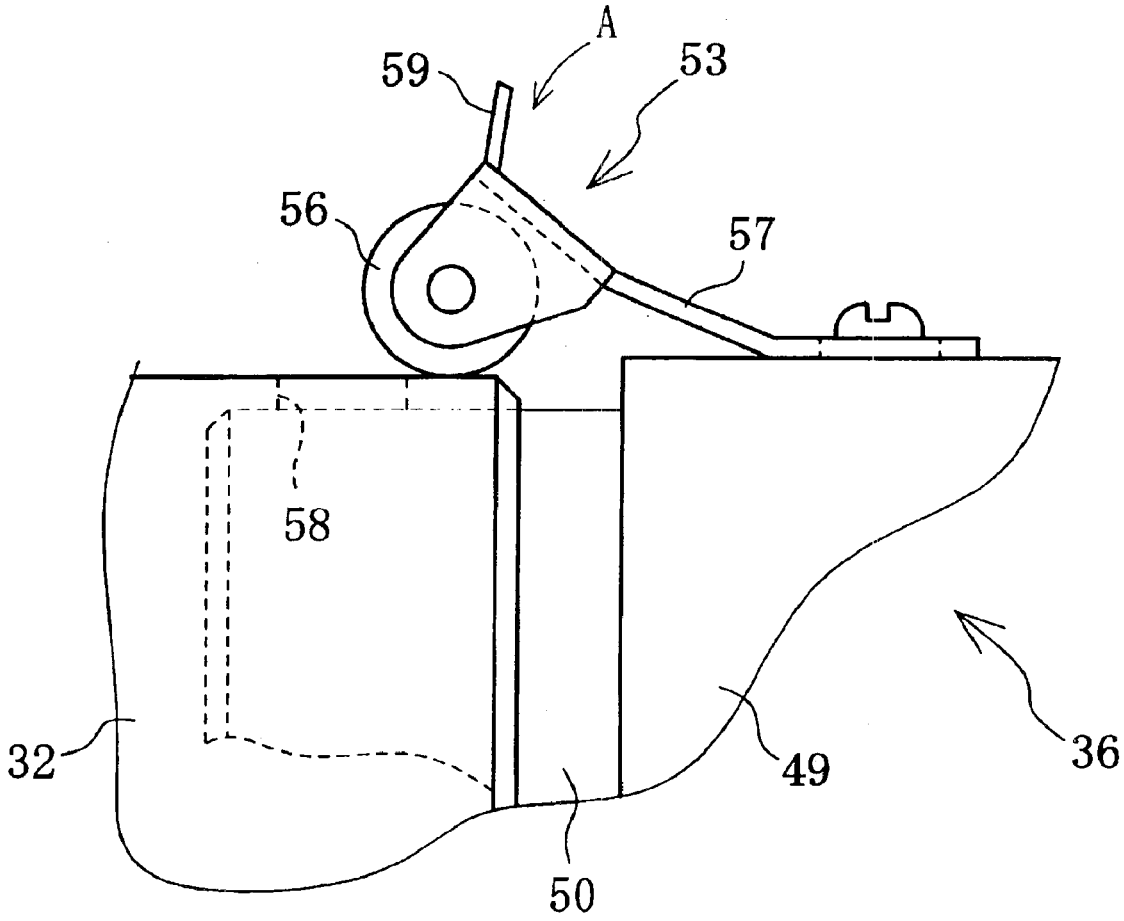
FIG. 8 is an enlarged view of the engaging member in a disengaged state.

The connecting mechanism 38 connects the base frame 34 to the moving frame 16 so that the base frame 34 is allowed to be moved in the Y direction together with the moving frame 16 and to be moved in the X direction relative to the moving frame 16, whereby drive of the moving frame 16 in the Y direction is transmitted to the cap frame support apparatus 30. A connecting member 72 is connected via an engaging member 71 to the base frame 34, and a Y-axis feeding member 75 is connected to the moving frame 16 so as to transmit drive in the Y direction to the base frame 34 as shown in FIG. 8. The connecting mechanism 38 connects the connecting member 72 and the Y-axis feeding member 75 together by a flanged shaft 73 which is inserted through both of them. In this case, an upper end of an operating lever 74 is pivotally mounted on the flanged shaft 73. The operating lever 74 is operated so that the flanged shaft 73 is switched to a fixed position, whereby the flanged shaft 73 is moved downward by a cramp mechanism (not shown) such that a flange 73*a* presses the Y-axis feeding member 75 against the connecting member 72. Consequently, the connecting member 72 is fixed to the Y-axis feeding member 75.

A pair of cap frame support plates 40 are disposed at right and left sides of the cylinder bed 8 in front of the cap frame support 50 as shown in FIGS. 2 to 5. Rear ends of the cap frame support plates 40 have proximal portions fixed to the connecting plate 39 and are mounted to a pair of right and left support bars 77 both extending frontward (in the Y direction), respectively. The cap support plates 40 have respective guide portions 40*a* formed so as to have the same curvature as the cap frame 32. The guide portions 40*a* are relatively slid along the inner periphery of the cap 95 so that a piece of cloth is stretched so as to cover a predetermined range extending between the right and left sides.

Each of the right and left guide rollers 41 includes a roller body 78 supported so as to be rotatable and extending back-to-front so that a distal end thereof reaches a distal end of the cap support plate 40, as shown in FIGS. 2 to 4. Each guide roller 41 further includes a roller rubber 79 formed in a rear half thereof and having a larger diameter and a larger coefficient of friction than the roller body 78. The guide rollers 41 are disposed so as to positionally correspond to the paired rotating rollers 42*a* and 42*b* located over the guide rollers 41 respectively. The roller rubber 79 of each guide roller 41 is fitted in a roller groove 80 formed in the inner periphery of the rotating frame 36 so that the rotating frame 36 is held between the roller rubber 79 and the rotating roller 42*a* (or 42*b*), whereby the rotating frame 36 is rotatably supported. A split roller (not shown) is mounted on a smaller-diameter portion 78*a* of the front end of the roller body 78, whereupon the wider cap frame can be attached.

Figure 7:
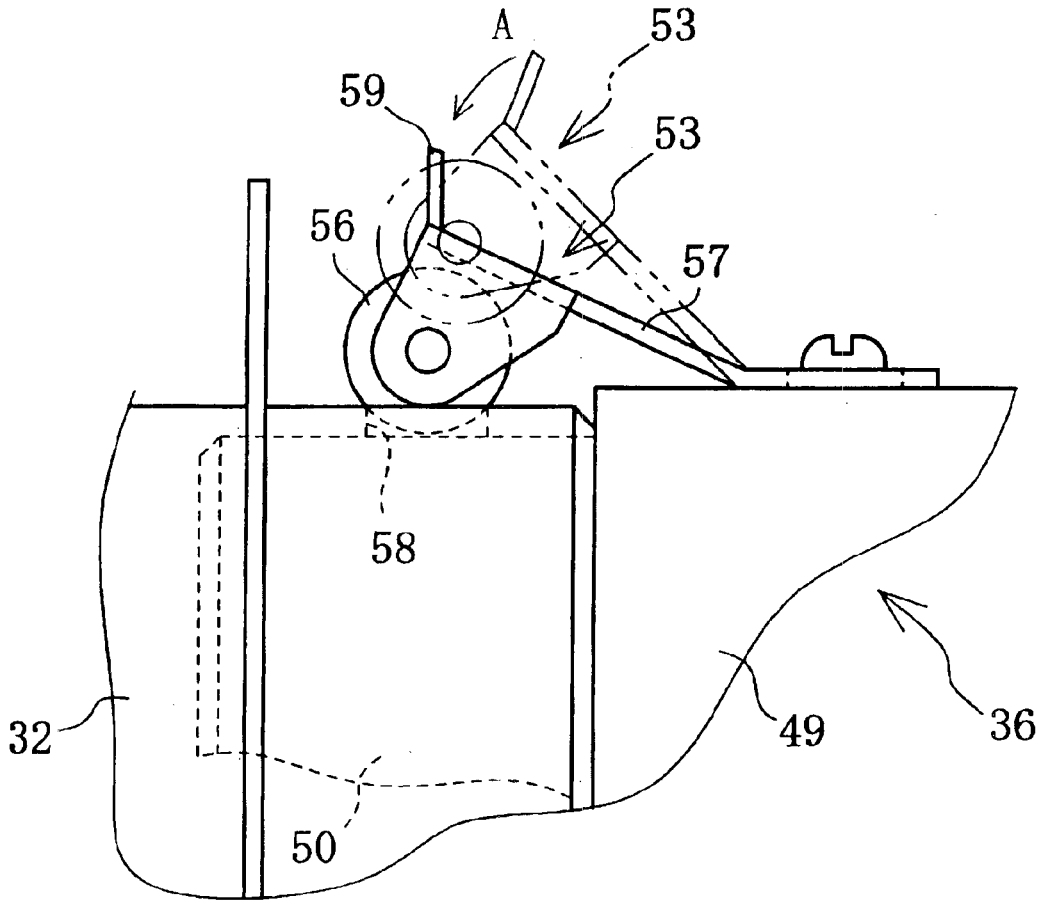
FIG. 7 is an enlarged view of the engaging member in an engaging state.
Figure 9:
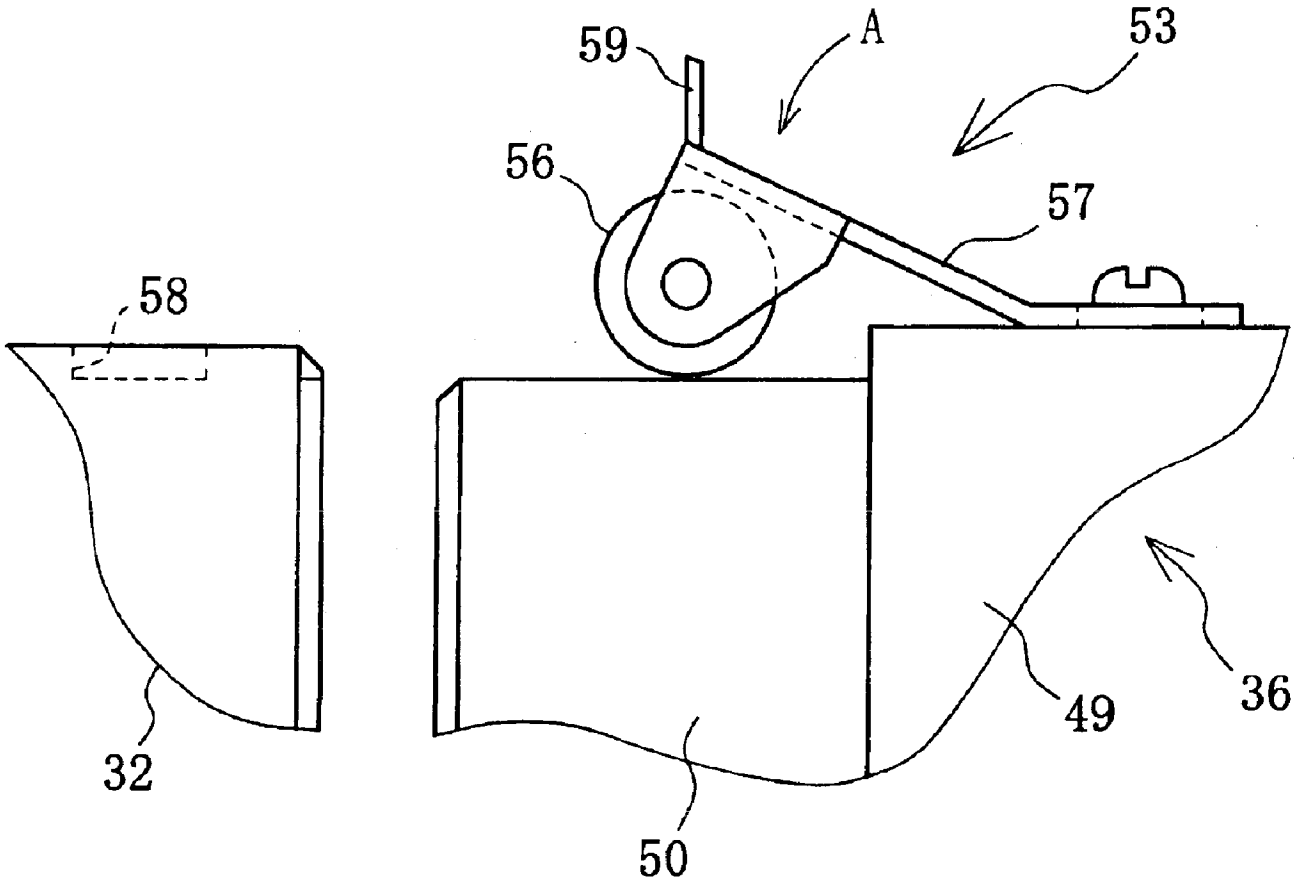
FIG. 9 is an enlarged view of the engaging member with the cap frame detached.

The engaging members 53 will be described in more detail with further reference to FIGS. 7 to 9. Each engaging member 53 includes a rolling member 56 mounted on a distal end of a leaf spring 57 serving as an elastic member as shown in FIGS. 7 to 9. The rolling member 56 is rotatable about an axis extending tangentially with respect to an outer periphery of the cap frame 32. The leaf spring 57 has a proximal end secured to the annular portion 49 of the rotating frame 36. The rolling member 56 is usually biased by the leaf spring 57 in the engaging direction (in the direction of arrow A in FIGS. 7 to 9). In this case, the engaging member 53 holds the cap frame 32 at an engagement position where the rolling member 56 is engaged with an engagement hole 58 of the cap frame 32. On the other hand, the rolling member 56 is disengaged from the engagement hole 58 when moved in the direction opposed to the arrow A thereby to be located at a retreat position, as shown by two-dot chain line in FIG. 7.

Each engaging member 53 includes a protrusion 59 serving as a pressed portion which is operated to press the support body 31 in the direction opposed to the direction in which the cap frame 32 is detached from the support body 31. The protrusion 59 provided on the distal end of the leaf spring 57 is located nearer to the cap frame 32 than a central axis of the rolling member 56. The protrusion 59 is formed integrally with the leaf spring 57 and protrudes generally perpendicularly to a direction of the outer periphery or the direction in which the cap frame 32 is detached from the support body 31. The protrusion 59 is located near a grip 92 of the cap frame 32 when the cap frame 32 has been attached to the support body 31. The grip 92 will be described in detail later. When detaching the cap frame 32, the operator can press the protrusion 59 toward the support body 31 side which is opposed to the direction in which the cap frame 32 is detached, as will be described in detail later. Simultaneously, the leaf spring 57 is elastically deformed so that the rolling member 56 can be moved to the retreat position.

The cap frame 32 will now be described. The cap frame 32 includes a generally semicircularly cylindrical cap support 84, a support shaft 89 extending frontward from a lower end of the cap support 84, and a pressing frame 85 rotatably mounted on the support shaft 89 so as to press the cap 95 with the cap support 84 being sandwiched therebetween, thereby holding the cap 95. The cap support 84 includes a supported portion 86 supported by the cap frame support 50 of the rotating frame 36, a generally rectangular opening defined by the pressing frame 85 so as to correspond to an embroidering region, and a visor support 88 supporting a visor 95*a* of the cap 95.

An upright portion 91 is secured to the supported portion 86. The upright portion 86 extends along an overall outer periphery of the supported portion 86 and stands outward perpendicularly to the supported portion 86. A pair of grips 92 are provided on the left and right ends of the upright portion 91 in order that the operator may grasp the grips 92 when the cap frame 32 is attached to or detached from the support body 31. The grips 92 are designed so as to be located near the protrusion 59 when the cap frame 32 is attached to the support body 31. Further, the protrusion 59 is located outside the visor 95*a* of the cap 95 held by the visor support 88.

In attaching the cap 95 to the cap frame 32, the cap 95 held in front of the cap frame 32 is put onto the cap support 84, and the pressing frame 85 is then put onto the cap 95 as shown in FIG. 2. The pressing frame 85 is fixed to the cap support 84 by a fixture 90 provided on the left end of the pressing frame 85. Thus, the cap 95 is fixed to the cap frame 32 while a piece of cloth corresponding to the embroidering region is stretched.

Figure 10:
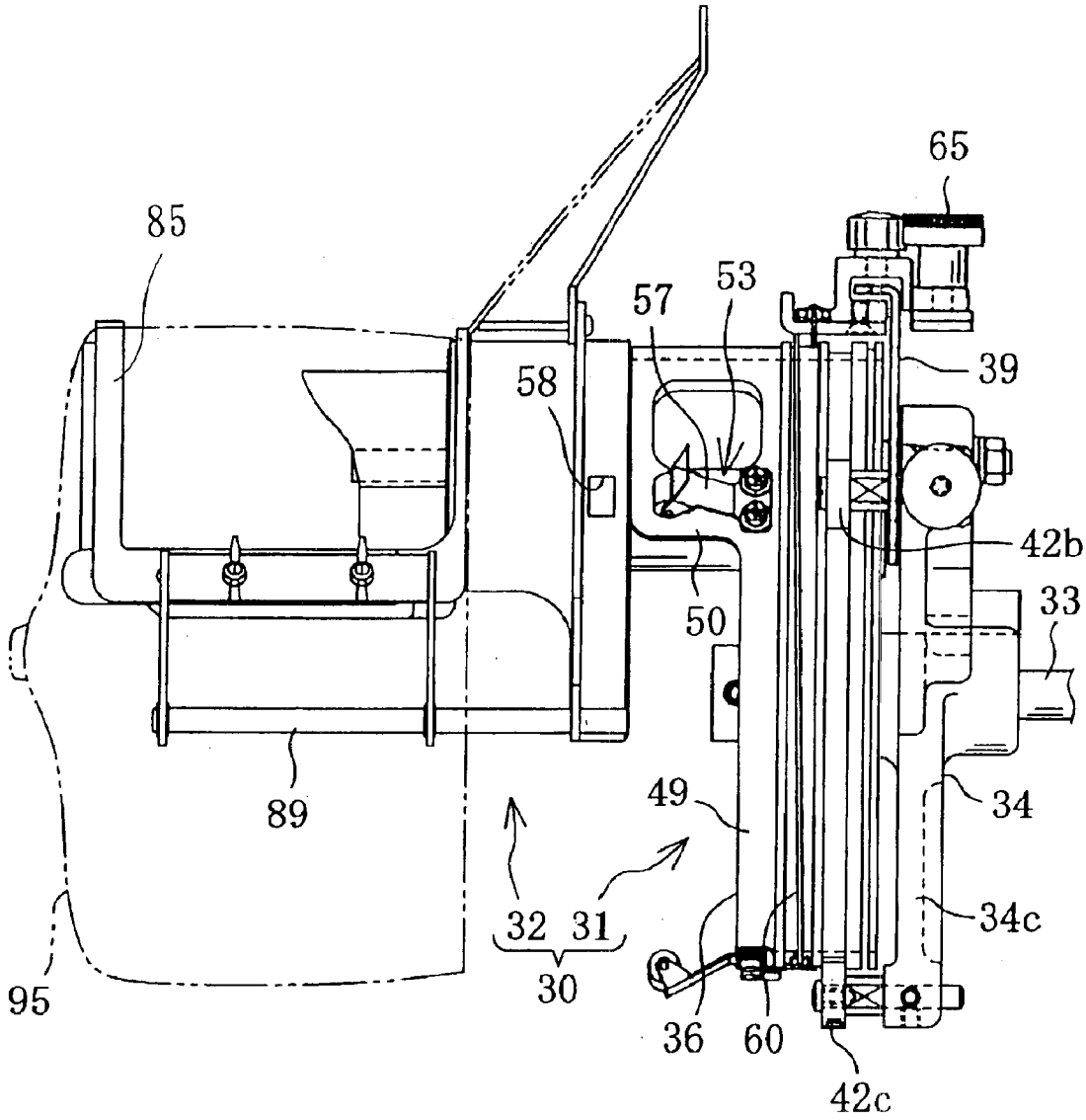
FIG. 10 is a side view of the cap frame supporting device with the cap frame detached.

The multi-head sewing machine will operate as follows. When the cap frame 32 on which the cap 95 is set is to be attached to rotating frame 36 of the support body 31, the operator grasps the paired grips 92 of the cap frame 32 and then positions the cap frame 32 as shown in FIG. 10. The cap frame 32 is then thrust into while the supported portion 86 of the cap frame 32 is fitted with the outer periphery of the cap frame support 50 of the rotating frame 36. The rolling members 56 engage the engagement hole 58 as the cap frame 32 is moved while the inner periphery of the supported portion 86 is slid on the outer periphery of the cap frame support 50. Consequently, the cap frame 32 is engaged with the rotating frame 36 by the engaging members 53 thereby to be fixed to the rotating frame 36. The rolling members 56 of the engaging members 53 are in abutment with the outer periphery of the cap frame 32 until engaging the engagement hole 58 as shown in FIG. 8. In this case, the frictional resistance of each rolling member 56 is small since the rolling members 56 roll on the outer periphery of the cap frame 32.

In the above-noted state, an embroidery sewing operation is carried out for the cap 95 as the article. In this case, the cap frame 32 to which the cap 95 is attached is moved in the Y direction together with the support body 31 and further rotated together with the rotating frame 36. Furthermore, the cap frame 32 is firmly fixed to the support frame 31 (the rotating frame 36) by means of engagement by the engaging members 53 and a frictional force produced between the supported portion 86 and the cap frame support 50. Consequently, the cap frame 32 can be prevented from being detached from the rotating frame 36 and from slipping out of place.

Figure 6:
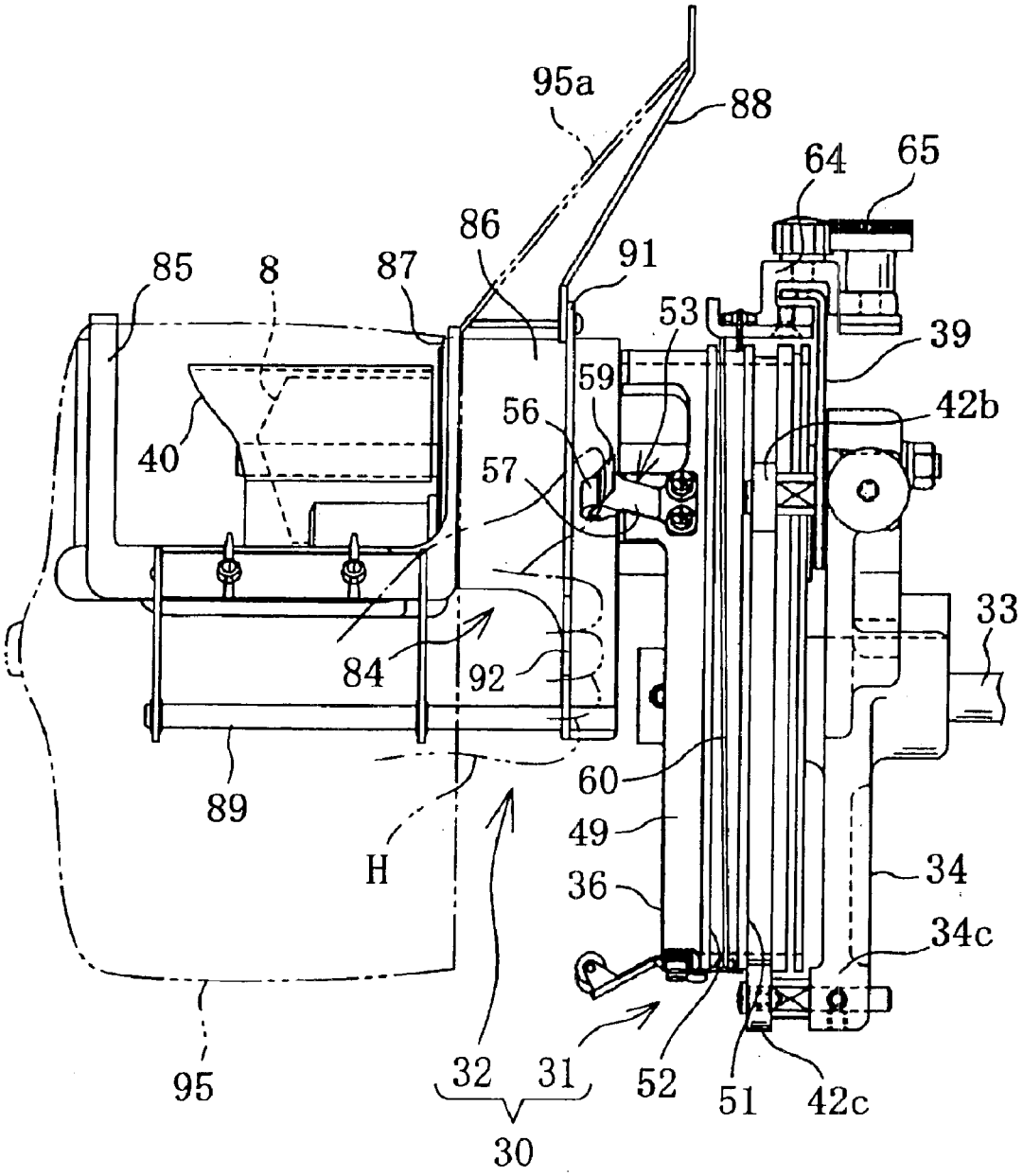
FIG. 6 is a side view of the cap frame support.

Upon completion of the embroidery sewing operation for the cap 95, the cap frame 32 is detached from the support body 31. In this case, the operator grasps the grips 92 of the cap frame 32 with fingers of his or her hands H except thumbs as shown in FIG. 6. The operator then pulls the cap frame 32 frontward while pressing the protrusions 59 of the left and right engaging members 53 rearward with his or her thumbs respectively. Since the protrusions 59 are located near the grips 92 so as to be easily pressed with the thumbs of the operator, he or she can press the protrusions 59 without strain. Furthermore, the pressing operation can be prevented from being obstructed by the visor 95*a* of the cap 95.

In the above-described state, firstly, each leaf spring 57 is elastically deformed by the pressing force applied to the protrusion 59 as shown by two-dot chain line in FIG. 7. As a result, each engaging member 53 is moved from the engagement position to the retreat position, and each rolling member 56 is disengaged from the engagement hole 58. At this time, the operator receives a reaction force of the pressing force applied to each protrusion 59. Since the operator can pull the cap frame 32 utilizing the reaction force, the cap frame 32 can easily be moved frontward. As shown in FIG. 8, the thumbs may be released from the respective protrusions 59 when the cap frame 32 is moved frontward to a position where the rolling members 56 are not allowed to engage the engagement hole 58. When further pulled frontward, the cap frame 32 can be detached from the rotating frame 36 (the support body 31) as shown in FIGS. 9 and 10. In this case, too, the rolling members 56 roll on the outer periphery of the cap frame 32, and accordingly, the frictional resistance of each rolling member 56 is small.

In the foregoing cap frame support 30 and the multi-head sewing machine M of the embodiment, the protrusions 59 serving as the pressed portions are provided on the distal ends of the engaging members 53 respectively. Accordingly, the operator can pull the cap frame in the detaching direction and detach it while pressing the protrusions 59 and utilizing the reaction force. Consequently, the detaching work can be carried out easier as compared with the case where the cap frame is merely only pulled. Further, the protrusions 59 are provided integrally on the respective engaging members 53, and pressing the protrusions 59 serves to disengage the rolling members 56 from the engagement hole 58. Consequently, the cap frame 32 can be detached from the support body 31 easier.

Each pressed portion comprises the protrusion 59 formed integrally on the leaf spring 57. Consequently, each pressed portion has a simple construction and can be operated easy. Further, a pair of the left and right protrusions 59 are provided and located near the left and right grips 92 respectively. Consequently, the operator can press the protrusions 59 with his or her thumbs while grasping the grips with his or her hands, respectively. Accordingly, the detaching work can be carried out with sufficient balance further easier.

Several modified forms of the foregoing embodiment will be described. In the foregoing embodiment, the invention is applied to each of the three multi-needle sewing machines M1 to M3 constructed into the multi-head sewing machine M. Each of the multi-needle sewing machines M1 to M3 includes the sewing head 4 having the needle bar case 5 provided with six needles and six needle bars. However, the invention may be applied to a sewing machine comprising a single sewing head having a single needle and a single needle bar.

The invention is applied to an industrial or quasi-occupational in the foregoing embodiment. However, the invention may be applied to various types of household sewing machines for personal use.

In the foregoing embodiment, the multi-head sewing machine M to which the invention is applied is incorporated integrally with the moving mechanism (the X-direction drive mechanism and the Y-direction drive mechanism). However, the invention may be applied to a sewing machine in which a moving mechanism for moving an embroidery frame can be separated from a sewing machine body, as disclosed by Japanese Patent No. 3178022.

The protrusions 59 are provided on the distal ends of the engaging members 53 respectively in the foregoing embodiment. However, the pressed portions may be provided on the rotating frame so as to be discrete, from the engaging member.

In the foregoing embodiment, each protrusion 59 is substantially perpendicular to the direction in which the cap frame is detached from the support body. However, when each protrusion is slightly inclined forward, the engaging member can be moved from the engagement position to the retreat position in a simpler manner.

The invention is applied to the cap frame supporting device 30 provided with the cap frame 32 in the foregoing embodiment. However, the invention may be applied to a sewing machine including a flat embroidery frame which is detachably attached thereto and which is directed to use with a flat cloth serving as the article to be sewn.

A pair of the left and right grips 92 and a corresponding pair of the left and right protrusions 59 are provided in the foregoing embodiment. However, a single grip and a single protrusion may be provided, instead. In this case, the grip is grasped by one of two hands, whereas the protrusion is pressed by the other hand so that the cap frame is detached from the support body.

The cap frame supporting device of the present invention includes a cap frame set frame which is disclosed by JP-A-11-21757 and in which the cap frame is manually rotated.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. An article supporting device detachably mounted on a sewing machine including a sewing machine body provided with a moving mechanism for moving an article to be sewn, thereby holding the article, the article supporting device comprising:

a support body mounted on the sewing machine body;

an engaging member mounted on the support body;

a support frame detachably attached to the support body by the engaging member while the article is held thereon; and a pressed portion provided on the engaging member to be pressed to disengage the engaging member from the support frame and so that the support body is pressed in a direction opposed to a direction in which the support frame is detached from the support body.

2. An article supporting device according to claim 1, wherein the support body includes a moving portion moved by the moving mechanism, and the support frame is coupled to the moving portion while attached to the support body so as to be moved with the moving portion.

3. An article supporting device according to claim 1, wherein the support frame is a cap frame holding a cap serving as the article.

4. An article supporting device according to claim 3, wherein a plurality of the pressed portions are provided so as to be spaced away from a center of the support body in opposite directions so that the pressed portions are substantially equidistant from the center of the support body.

5. An article supporting device according to claim 3, wherein the pressed portion comprises a protrusion protruding approximately perpendicularly to a direction in which the cap frame is detached.

6. An article supporting device according to claim 3, wherein the cap frame includes a grip grasped when the cap frame is to be attached to and detached from the support body, and the pressed portion is located near the grip when the cap frame has been attached to the support body.

7. An article supporting device according to claim 6, wherein a plurality of the grips are provided and a plurality of the pressed portions are provided so as to correspond to the grips respectively.

8. An article supporting device according to claim 3, wherein the cap frame includes a visor support holding a visor of the cap, and the pressed portion is positioned outside the visor of the cap held by the visor support.

9. An article supporting device according to claim 3, wherein the support body includes an engaging member capable of moving between an engagement position where the engaging member engages the cap frame thereby to hold the cap frame and a retreat position where the engaging member disengages the cap frame, the pressed portion is provided on the engaging member, and the pressed portion is pressed such that the engaging member is moved from the engagement position to the retreat position.

10. An article supporting device according to claim 9, wherein the cap frame includes an engaged portion, the engaging member includes a rolling member engaging the engaged portion of the cap frame when the engaging member is located at the engagement position, and the pressed portion is located nearer to the cap frame than a central axis of the rolling member.

11. An article supporting device according to claim 10, wherein the rolling member is rotatable in the directions in which the cap frame is attached to and detached from the support body.

12. A sewing machine which includes a sewing machine body further including a moving mechanism for moving an article to be sewn, the sewing machine comprising:

an article supporting device holding a cap serving as the article to be sewn and including a support body mounted on the sewing machine body, an engaging member mounted on the support body, a cap frame detachably attached to the support body by the engaging member while the cap is held on the cap frame, and a pressed portion provided on the engaging member, to disengage the engaging member from the support body, to be pressed so that the support body is pressed in a direction opposed to a direction in which the cap frame is detached from the support body.

* * * * *